US009887453B2

(12) United States Patent
Pruett et al.

(10) Patent No.: US 9,887,453 B2
(45) Date of Patent: Feb. 6, 2018

(54) BALLISTIC RADOME WITH EXTENDED FIELD OF VIEW

(71) Applicant: RAYTHEON COMPANY, Waltham, MA (US)

(72) Inventors: James A. Pruett, Allen, TX (US); Kuang-Yuh Wu, Plano, TX (US)

(73) Assignee: RAYTHEON COMPANY, Waltham, MA (US)

( * ) Notice: Subject to any disclaimer, the term of this patent is extended or adjusted under 35 U.S.C. 154(b) by 777 days.

(21) Appl. No.: 14/200,940

(22) Filed: Mar. 7, 2014

(65) Prior Publication Data

US 2016/0248150 A1 Aug. 25, 2016

Related U.S. Application Data

(60) Provisional application No. 61/816,997, filed on Apr. 29, 2013.

(51) Int. Cl.
*H01Q 1/42* (2006.01)
*H01Q 1/32* (2006.01)

(52) U.S. Cl.
CPC ..... *H01Q 1/42* (2013.01); *H01Q 1/32* (2013.01)

(58) Field of Classification Search
CPC ..... H01Q 1/42; H01Q 1/32
USPC ..... 343/872
See application file for complete search history.

(56) References Cited

U.S. PATENT DOCUMENTS

| | | | | |
|---|---|---|---|---|
| 5,216,435 | A * | 6/1993 | Hirata | H01Q 1/28 333/1 |
| 5,392,053 | A | 2/1995 | Hirata et al. | |
| 5,652,631 | A | 7/1997 | Bullen et al. | |
| 7,286,096 | B2 | 10/2007 | Jaffer et al. | |
| 7,541,970 | B1 | 6/2009 | Godfrey et al. | |
| 8,179,335 | B2 * | 5/2012 | Chereson | H01Q 1/40 343/700 MS |
| 8,184,064 | B2 | 5/2012 | Sanford | |
| 8,368,610 | B2 | 2/2013 | Kviatkofsky et al. | |
| 2007/0229374 | A1 * | 10/2007 | Shimura | B60C 23/0408 343/713 |

* cited by examiner

*Primary Examiner* — Dameon E Levi
*Assistant Examiner* — Jennifer F Hu
(74) *Attorney, Agent, or Firm* — Cantor Colburn LLP

(57) ABSTRACT

A ballistic radome is provided and includes a flattened radome portion disposable in a primary field of view (FOV) of an antenna and a curved radome portion configured to define an extended FOV of the antenna about the primary FOV.

15 Claims, 4 Drawing Sheets

BALLISTIC RADOME WITH EXTENDED FIELD OF VIEW

CROSS REFERENCE TO RELATED APPLICATION

This application is a Non-Provisional of U.S. Provisional Application No. 61/816,997 filed Apr. 29, 2013, the disclosures of which are incorporated by reference herein in their entireties.

BACKGROUND

The present disclosure relates to a ballistic radome, and more specifically, to a ballistic radome with an extended field of view.

A vehicle that needs to communicate with an off-board system may include one or more antennas. These antennas are often arranged in antenna arrays that include multiple transmission and reception modules. These antenna arrays are often referred to as electronically scanned arrays (ESAs). The ESAs for a given vehicle are generally disposed at an exterior of the vehicle so that data transmitted between the vehicle and the off-board system need not pass through the exterior of the vehicle. As such, the ESAs often need to be protected by one or more radomes that permit electromagnetic radiation of certain frequencies to be transmitted to and from the ESAs with little to no interference at wide angle ranges. Since these radomes are often located along with the ESAs at the exterior of the vehicle, the radomes are often also required to protect the ESAs from atmospheric conditions, such as humidity, and from impacts by foreign objects, such as armor piercing projectiles. Radomes that are particularly suited for such additional protection may be referred to as "ballistic radomes." A ballistic radome can be much thicker than the conventional half-wave wall, A-sandwich, B-sandwich or C-sandwich radomes.

During vehicle use, if an ESA becomes non-functional, the area of electromagnetic radiation transmission that is affected by the lost ESA needs to be covered. Frequently, such coverage may be provided by the ESAs on either side of the non-functional ESA. In these cases, the functional ESAs may be configured to have extended respective fields of view (FOVs) to thereby provide some amount of coverage for the affected area. However, for ESAs that have ballistic radomes, the thick ballistic radomes may have to be unrealistically large in order to accommodate the extended FOVs. In other cases, the ballistic radomes may be provided with curved radome surfaces that allow for extended FOVs but cause distortion in the transmitted electromagnetic radiation.

SUMMARY

According to one embodiment, a ballistic radome is provided and includes a flattened radome portion disposable in a primary field of view (FOV) of an antenna and a curved radome portion configured to define an extended FOV of the antenna about the primary FOV.

According to another embodiment, a ballistic radome for use with an antenna having a primary field of view (FOV) is provided. The ballistic radome includes a flattened radome portion disposable in the primary FOV and a curved radome portion configured to define an extended FOV of the antenna about the primary FOV. The flattened radome portion includes an outer edge, which is disposable at a periphery of the primary FOV. The curved radome portion includes a forward edge, which is configured to be affixed to the outer edge.

According to another embodiment, a radome system is provided and includes an antenna having a primary field of view (FOV) and a ballistic radome supportively disposable proximate to the antenna. The ballistic radome includes a flattened radome portion disposable in the primary FOV and a curved radome portion configured to define an extended FOV of the antenna about the primary FOV.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

The description provided herein relates to a radome system for an antenna (i.e., an ESA) having a primary field of view (FOV). The radome system includes a ballistic radome that itself includes a substantially flat ballistic radome portion in the primary FOV and a curved or faceted ballistic radome portion that defines an extended FOV. The substantially flat ballistic radome portion in the primary FOV will permit transmission of electromagnetic radiation with minimal or reduced distortion and/or loss. The curved or faceted ballistic radome portions allows for a smaller radome footprint, but provides the extended or wider FOV. The curved or faceted ballistic radome portion thus saves valuable real estate on a vehicle and reduces weight and costs as well.

For the extended FOV defined by the curved or faceted ballistic radome portion, there could be degraded performance due to distortion and/or loss, but this is acceptable since the extended FOV is used in concert with the primary FOV and may only be required when an antenna becomes non-functional. In addition, the substantially flat ballistic radome portion may be relatively small and lightweight as compared to other radomes.

The radome system thus provides for undiminished performance in the primary FOV of the antenna despite the extended FOV capability and does not require additional space, weight or material for the extended FOV capability. In addition, a curvature around a periphery of the curved radome portion can provide for a corner armor solution.

Figure 1:
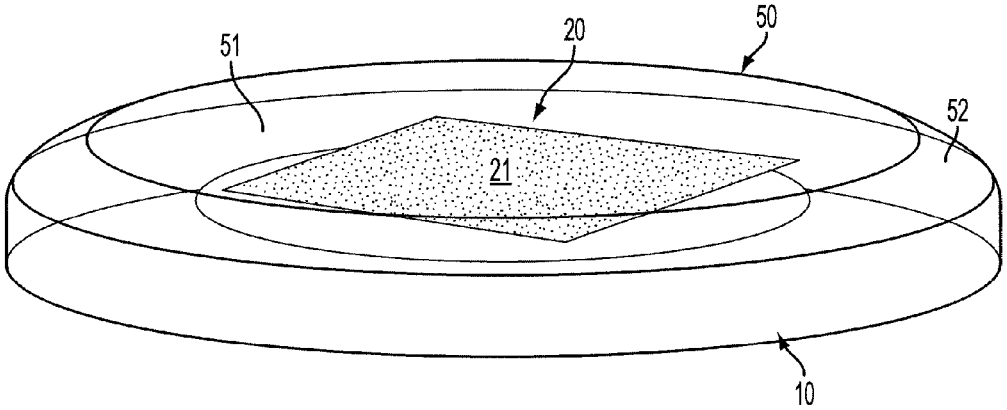
FIG. 1 is a perspective view of a ballistic radome of a radome system in accordance with embodiments.
Figure 4:
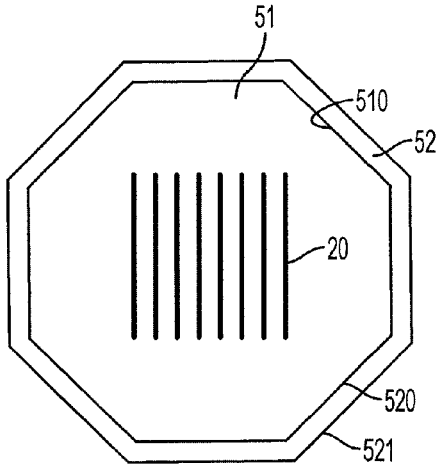
FIG. 4 is a plan view of a ballistic radome in accordance with alternative embodiments.
Figure 5:
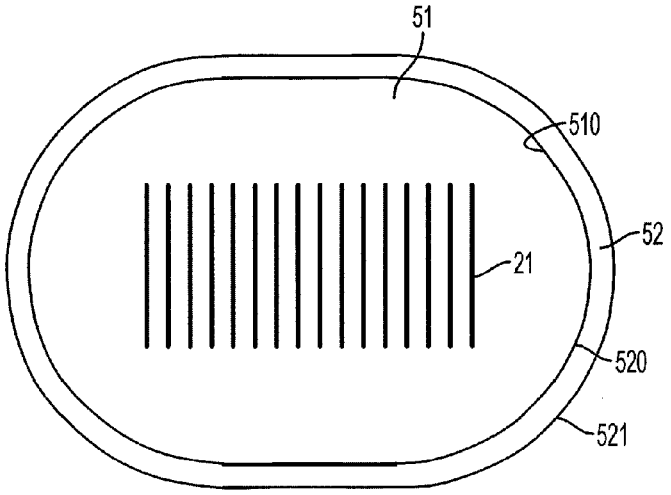
FIG. 5 is a plan view of a ballistic radome in accordance with alternative embodiments.
Figure 6:
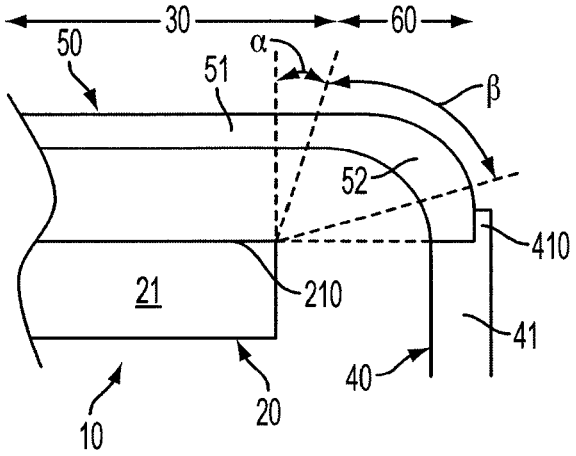
FIG. 6 is a partial side view of the radome system of FIG. 1.

With reference to FIGS. 1-8, a radome system 10 is provided. FIG. 1 illustrates an inner surface of the radome system 10. For simplicity, certain features of the radome wall structure and thickness are variable in accordance with design considerations and application of the radome system 10 and are not shown. The radome system 10 includes an antenna or, more particularly, an antenna array 20. This antenna array 20 may be provided as an electronically scanned array (ESA) 21 and has a primary field of view (FOV) 30 (see FIG. 6). As shown in FIG. 1, the ESA 21 may be but is not required to be substantially rectangular in cross-sectional shape and, as shown in FIG. 6, may include a substantially flat, planar surface 210. Most, if not all, of the transmitted electromagnetic radiation passes through this surface 210. The primary FOV 30 is generally defined outwardly from the surface 210 at angles that range from a normal angle (i.e., perpendicular to a plane of the surface 210) to an acute angle (i.e., transverse to the normal angle). The magnitude of the acute angle can vary based on a type of the ESA and a type of the transmitted electromagnetic radiation. For purposes of clarity and brevity it will be assumed that the acute angle is a predefined angle $\alpha$, as shown in FIG. 6.

The radome system 10 further includes a structural support 40 and a ballistic radome 50. As shown in FIG. 6, the structural support 40 is disposed perimetrically about the ESA 20 and includes a structural wall 41, which may not be designed for radio frequency (RF) transmission. The structural wall 41 extends substantially in parallel with a side of the ESA 20 and generally terminates at the plane of the surface 210. The structural wall 41 includes a flange 410 at an outer diameter thereof that protrudes beyond the plane of the surface 210 and serves to secure the ballistic radome 50 in place. In accordance with some embodiments, the flange 410 may terminate at a plane of an interior surface of the ballistic radome 50.

The ballistic radome 50 is supportively disposable on the structural wall 41 within the flange 410 such that the ballistic radome 50 is proximate to the ESA 20. The ballistic radome 50 includes a substantially flattened radome portion 51 and a curved (or faceted) radome portion 52. With the ballistic radome 50 supportively disposable on the structural wall 41, the substantially flattened radome portion 51 is disposable in the primary FOV 30. Meanwhile, the curved radome portion 52 is configured to define an extended FOV 60 of the ESA 20 about the primary FOV 30.

As shown in FIG. 6, the extended FOV 60 will have angular ranges from the predefined angle $\alpha$ to the extended angle $\beta$. At this extended angle, which may be substantially transverse with respect to the normal angle, it is possible that the electromagnetic radiation transmitted with respect to the ESA 20 will experience distortion and/or loss. It is also possible that such distortion or losses will be increased by the curvature of the curved radome portion 52. The distortion and/or loss can be improved by applying proper phase calibration. Some distortion or loss are acceptable due to the fact that the angular range at which transmission of electromagnetic radiation is permitted is substantially increased by the ballistic radome 50 without a corresponding increase in size, weight or material of the ballistic radome 50.

The substantially flattened radome portion 51 includes an outer edge 510. The outer edge 510 is disposable at a periphery of the primary FOV 30. The curved radome portion 52 includes a forward edge 520 and a rearward edge 521. The forward edge 520 is configured to be affixed to the outer edge 510 of the substantially flattened portion 51. The rearward edge 521 may be substantially coplanar with the surface 210 of the ESA 20 and may be surrounded by the flange 410. In accordance with embodiments, the rearward edge 521 may be press fit inside the flange 410 or, alternatively, the flange 410 may be fastened to an outer periphery of the curved radome portion 52 by fastening elements, such as screws, bolts and/or adhesive.

With reference to FIGS. 1, 2-5, 7 and 8, it will be understood that the shape of the ballistic radome 50 and the ESA 20 can vary in accordance with multiple alternative embodiments. A selection of these alternative embodiments is described herein but is not intended to otherwise limit the scope of the application in any way. Other shapes and sizes of the ballistic radome 50 are of course possible. In addition, it will be further understood that the embodiments described herein may be provided alone or in combination with one another.

Figure 2:
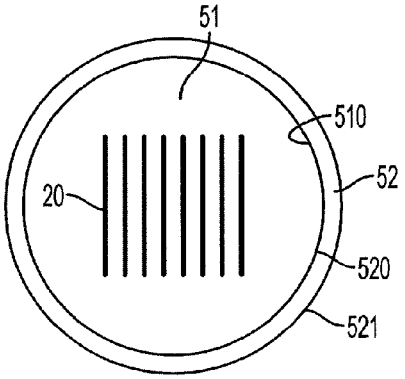
FIG. 2 is a plan view of the ballistic radome of FIG. 1.
Figure 3:
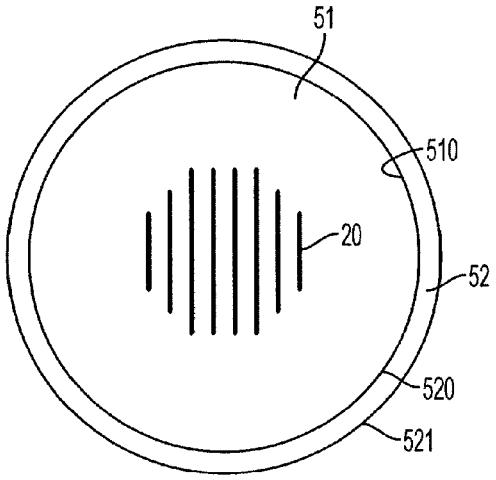
FIG. 3 is a plan view of a ballistic radome in accordance with alternative embodiments.

As an exemplary embodiment and as shown in FIGS. 2 and 3, the outer edge 510 of the substantially flattened radome portion 51, the forward edge 520 of the curved radome portion 52 and the rearward edge 521 of the curved radome portion 52 may be substantially elliptical or circular, angular as shown in FIG. 4 or oval-shaped as shown in FIG. 5. In some or all of these cases, the outer edge 510, the forward edge 520 and the rearward edge 521 may be smoothly defined around a perimeter of the ESA 20. Moreover, in some or all of these cases, the ESA 20 may be square or rectangular as shown in FIGS. 2, 4 and 5 or polygonal as shown in FIG. 3.

Figure 7:
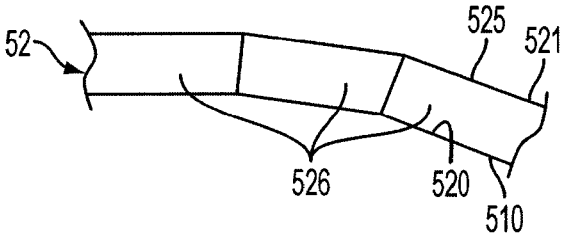
FIG. 7 is a plan view of a portion of the ballistic radome of FIG. 1 in accordance with further embodiments.

In accordance with another exemplary embodiment and, as shown in FIG. 7, the outer edge 510 of the substantially flattened radome portion 51, the forward edge 520 of the curved radome portion 52 and the rearward edge 521 of the curved radome portion 52 may be straight and parallel with each other. In this case, the curved radome portion 52 may include a faceted surface 525 and thus may be formed of a plurality of faces 526 arrayed in one or more rows around a perimeter of the ESA 20.

Figure 8:
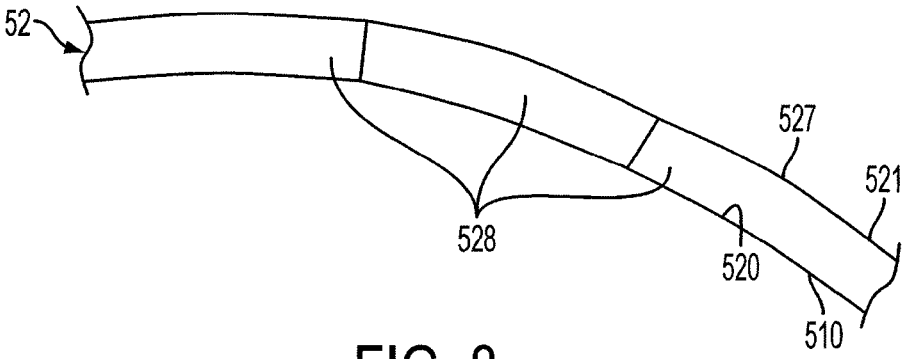
FIG. 8 is a plan view of a portion of the ballistic radome of FIG. 1 in accordance with further alternative embodiments.

In accordance with another exemplary embodiment and, as shown in FIG. 8, the outer edge 510 of the substantially flattened radome portion 51, the forward edge 520 of the curved radome portion 52 and the rearward edge 521 of the curved radome portion 52 may be segmented and parallel with each other, with each segment being curved. In this case, the curved radome portion 52 may include a scalloped surface 527 and thus may be formed of a plurality of scallop faces 528 arrayed in one or more rows around a perimeter of the ESA 20.

Figure 9:
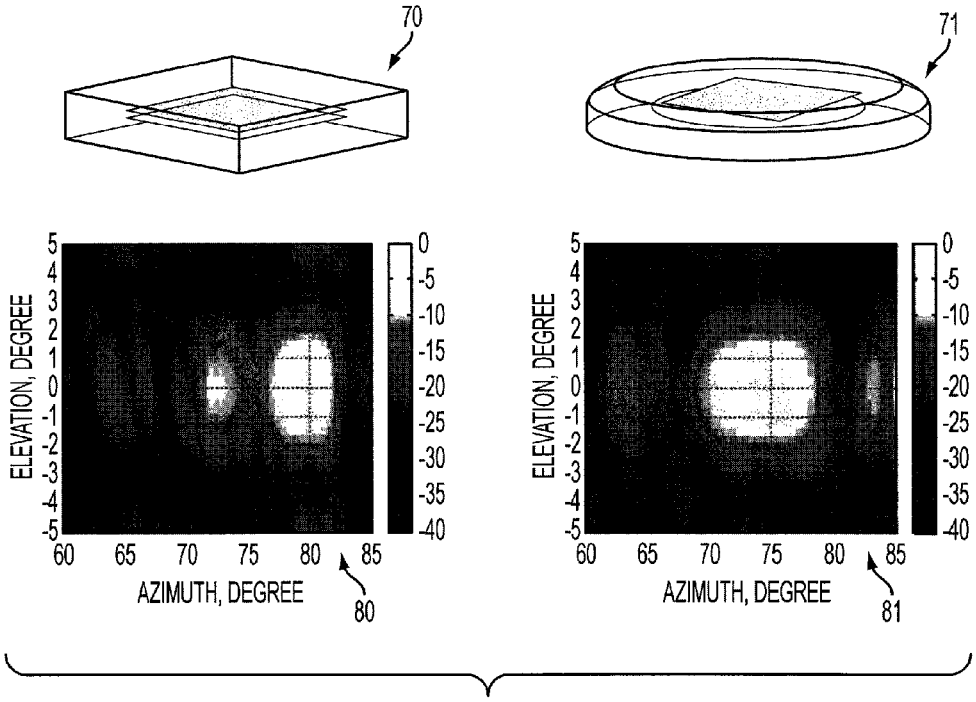
FIG. 9 is a graphical depiction of loss performance of the ballistic radome of FIG. 1.

As described above and, with reference to FIG. 9, the radome system 10 includes the substantially flattened radome portion 51 in the primary FOV 30 of the ESA 20 and a curved (or faceted) radome portion 52 for the extended FOV 60. The primary FOV 30 will thus have minimal distortion and/or loss. As shown in FIG. 9, the FOV 80 and beyond was totally blocked by the structural wall 70 of the flat ballistic radome. On the other embodiments, the curved section 71 of the curved ballistic radome provides the extended window 81 and beyond. Hence, the curved radome allows a smaller radome footprint while providing a wider FOV.

In accordance with still further embodiments, it will be understood that the ballistic radome 50 may be formed of a single component or multiple, layered components. In either case, the ballistic radome 50 material may be selected to be impedance matched with the ESA 20 and/or the other features of the radome system 10. Where the ballistic radome 50 is formed of multiple, layered components, the ballistic radome 50 may be formed in a manner similar to the description provided in U.S. Patent Application No. 2012/009229 (and U.S. Patent Application No. 2008/0136731 and U.S. Pat. No. 7,817,099), entitled "Broadband Ballistic Resistant Radome." The radome may also be made from multiple components across the face of the radome. For instance, if ceramic is used, the overall ceramic shape may be composed of individual pieces of ceramic instead of a monolithic piece.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A ballistic radome, comprising:

a flattened radome portion disposable in a primary field of view (FOV) of an antenna, the primary FOV being defined to extend at least at a normal angle from an entirety of a surface of the antenna;

a curved radome portion configured to define an extended FOV of the antenna about the primary FOV; and a structural support disposable at an outer periphery of the curved radome portion and comprising a flange which protrudes forwardly beyond a plane of the surface of the antenna, wherein:

the flattened radome portion comprises an outer edge that is disposable at and outside a periphery of the primary FOV, and the curved radome portion comprises a forward edge affixed to the outer edge, a first rearward edge coplanar with the surface of the antenna and a second rearward edge transverse to the first rearward edge and abuttable with an interior face of the flange.

2. The ballistic radome according to claim 1, wherein the outer edge of the flattened radome portion and the forward and rearward edges of the curved radome portion are substantially elliptical.

3. The ballistic radome according to claim 1, wherein the outer edge of the flattened radome portion and the forward and rearward edges of the curved radome portion are faceted.

4. The ballistic radome according to claim 1, wherein the curved radome portion comprises a faceted surface.

5. The ballistic radome according to claim 1, wherein the curved radome portion comprises a scalloped surface.

6. A ballistic radome for use with an antenna having a primary field of view (FOV) defined to extend at least at a normal angle from an entirety of a surface of the antenna, the ballistic radome comprising:

a flattened radome portion disposable in the primary FOV;

a curved radome portion configured to define an extended FOV of the antenna about the primary FOV; and a structural support disposable at an outer periphery of the curved radome portion and comprising a flange which protrudes forwardly beyond a plane of the surface of the antenna, the flattened radome portion including an outer edge, which is disposable at and outside of a periphery of the primary FOV, and the curved radome portion including a forward edge affixable to the outer edge, a first rearward edge coplanar with the surface of the antenna and a second rearward edge transverse to the first rearward edge and abuttable with an interior face of the flange.

7. The ballistic radome according to claim 6, wherein the outer edge of the flattened radome portion and the forward edge of the curved radome portion are substantially elliptical.

8. The ballistic radome according to claim 6, wherein the outer edge of the flattened radome portion and the forward edge of the curved radome portion are faceted.

9. The ballistic radome according to claim 6, wherein the curved radome portion comprises a faceted surface.

10. The ballistic radome according to claim 6, wherein the curved radome portion comprises a scalloped surface.

11. A radome system, comprising:

an antenna having a primary field of view (FOV) defined to extend at least at a normal angle from an entirety of a surface of the antenna;

a ballistic radome supportively disposable proximate to the antenna and comprising a flattened radome portion disposable in the primary FOV and a curved radome portion configured to define an extended FOV of the antenna about the primary FOV; and a structural support disposable at an outer periphery of the curved radome portion and comprising a flange which protrudes forwardly beyond a plane of the surface of the antenna, wherein:

the flattened radome portion comprises an outer edge disposable at and outside a periphery of the primary FOV, and the curved radome portion comprises a forward edge affixable to the outer edge, a first rearward edge that is coplanar with the surface of the antenna and a second rearward edge transverse to the first rearward edge and abuttable with an interior face of the flange.

12. The radome system according to claim 11, wherein the outer edge of the flattened radome portion and the forward and rearward edges of the curved radome portion are substantially elliptical.

13. The radome system according to claim 11, wherein the outer edge of the flattened radome portion and the forward and rearward edges of the curved radome portion are faceted.

14. The ballistic radome according to claim 11, wherein the curved radome portion comprises a faceted surface.

15. The ballistic radome according to claim 11, wherein the curved radome portion comprises a scalloped surface.

* * * * *